US006139652A

United States Patent [19]

Carrano et al.

[11] Patent Number: 6,139,652

[45] Date of Patent: Oct. 31, 2000

[54] TARNISH-RESISTANT HARDENABLE FINE SILVER ALLOYS

[75] Inventors: Richard V. Carrano, Attleboro, Mass.; Ronald A Mondillo, East Greenwich, R.I.

[73] Assignees: Stern-Leach, Attleboro, Mass.; Ronald Mondillo, East Greenwich, R.I.

[21] Appl. No.: 09/136,089

[22] Filed: Aug. 18, 1998

Related U.S. Application Data

[63] Continuation-in-part of application No. 08/788,050, Jan. 23, 1997, abandoned.

[51] Int. Cl.[7] ..... C22C 5/06

[52] U.S. Cl. ..... 148/431; 148/430; 420/506; 420/501

[58] Field of Search ..... 148/405, 430, 148/431, 538, 678; 420/501, 506

[56] References Cited

U.S. PATENT DOCUMENTS 5,171,643 12/1992 Suzuki et al. ..... 428/671

FOREIGN PATENT DOCUMENTS

| | | |
|---|---|---|
| 27 52 546 | 7/1979 | Germany . |
| 56-19629 | 2/1981 | Japan . |
| 57-194231 | 11/1982 | Japan . |
| 60-162741 | 8/1985 | Japan . |
| 61-246336 | 11/1986 | Japan . |
| 61-246337 | 11/1986 | Japan . |
| 62-130239 | 6/1987 | Japan . |
| 62-130240 | 6/1987 | Japan . |
| 62-130241 | 6/1987 | Japan . |
| 62-130242 | 6/1987 | Japan . |
| 62-130243 | 6/1987 | Japan . |
| 62-130244 | 6/1987 | Japan . |
| 62-130245 | 6/1987 | Japan . |
| 62-158839 | 7/1987 | Japan . |
| 64-87736 | 3/1989 | Japan . |

OTHER PUBLICATIONS

ASTM Designation B4 13–97a, "Standard Specification for Refined Silver", pp. 323 and 324, Apr. 1997.

*Metals Handbook*, "Properties of Silver and Silver Alloys", vol. 2, pp. 662 and 671–674, 1979.

Raykhtsaum, A. et al., "The New Gold Color Reference Kit Takes the Guesswork Out of Describing Gold Color", pamphlet entitled *AJM, Gold: Showing its true colors*, Oct. 1994.

Handy & Harman, "Silver, The Handy Book of Silver", 18 pages, 1996.

*Primary Examiner*—John Sheehan

*Attorney, Agent, or Firm*—Gregory S. Rosenblatt; Wiggin & Dana

[57] ABSTRACT

A fine silver alloy composition having at least about 99.5 weight percent silver, with the balance containing an element, or an oxide of an element, selected from the group consisting of: aluminum, antimony, cadmium, gallium, germanium, indium, lithium, manganese, magnesium, silicon, tin, titanium and zinc, the alloy composition having been formed by combining silver having a purity of at least about 99.90 weight percent with an element, or an oxide of an element, selected from the group, in a substantially non-oxidizing atmosphere. The alloy composition may be annealed in a substantially non-oxidizing atmosphere. The silver alloy composition may be hardened by internal oxidation. The composition is capable of being aged hardened to at least 136 percent of its annealed hardness, and this hardening may be irreversible. The composition may be resistant to tarnishing, and may have an aged hardness of at least about 48 VHN. The internal oxidation may be furthered by heating the alloy to a temperature of between about 800° F. and 1300° F. in an oxygen-containing atmosphere. The oxygen-containing atmosphere may contain at least about 20% oxygen. The non-oxidizing atmosphere may be about 75 weight percent hydrogen and about 25 weight percent oxygen. The non-oxidizing annealing atmosphere may be a reducing atmosphere.

11 Claims, 2 Drawing Sheets

TARNISH-RESISTANT HARDENABLE FINE SILVER ALLOYS

This application is a continuation-in-part of application Ser. No. 08/788,050 filed on Jan. 23, 1997 now abandoned.

TECHNICAL FIELD

The present invention relates generally to fine silver alloys (i.e., having at least 99.5 weight percent silver), and, more particularly, to improved fine silver alloys that are resistant to tarnishing and that may be selectively hardened to levels far beyond that possessed by pure silver.

BACKGROUND ART

Pure silver is a lustrous, white, ductile and malleable metal that occurs in both uncombined form and in ores. This element is highly valued for jewelry, tableware, and other ornamental use. Pure silver is relatively soft and unhardenable. For example, pure silver may have an annealed hardness on the order of 35 Vickers Hardness Number ("VHN"). It has been applicants' experience that this material may not be age-hardened. Thus, pure silver is comparatively soft and unhardenable.

Because of this, it is necessary to alloy silver with other elements in an attempt to increase the hardenability of the resulting alloy. For example, sterling silver typically contains 92.5 weight percent silver, and 7.5 weight percent copper. Whereas pure silver has an annealed hardness of about 35 VHN, applicants' experience is that sterling silver has an annealed hardness of about 80 VHN, and may be selectively hardened to about 110 VHN, a substantial increase over that available for pure silver. However, sterling silver tarnishes easily and is not pure.

Because silver is a precious metal, it is often valued by its purity. Heretofore, it has not been possible to commercially manufacture a fine silver alloy having properties adapted for use as fine jewelry, tabletop and accessories.

To this end, applicants have developed certain fine silver alloys (i.e., alloys having at least 99.5 weight percent silver). In these alloys, the high amount of silver is alloyed with selective elements in comparatively low quantities. However, as demonstrated herein, applicants have developed various alloy compositions that are uniquely hardenable to levels far beyond that possessed by sterling silver and pure silver, and are far more tarnish-resistant than sterling silver.

DISCLOSURE OF THE INVENTION

The present invention broadly provides various fine silver alloy compositions having at least about 99.5 weight percent silver. In one form, silver is alloyed with an element, or an oxide of an element, selected from the group consisting of: aluminum (Al), antimony (Sb), cadmium (Cd), gallium (Ga), germanium (Ge), indium (In), lithium (Li), manganese (Mn), magnesium (Mg), silicon (Si), tin (Sn), titanium (Ti) and zinc (Zn) by combining silver having a purity of at least about 99.90 weight percent with an element, or oxide of an element, selected from the group, in a substantially non-oxidizing atmosphere.

The improved silver alloy composition may be formed by annealing the alloy composition in a substantially non-oxidizing atmosphere. The improved silver alloy composition may also be formed by hardening the alloy by internal oxidation. The alloy composition may be hardened to at least 136 percent of its annealed hardness, may have an aged hardness of at least about 48 VHN, and the hardenability of the alloy composition may be irreversible. In addition, the alloy composition may be tarnish-resistant and at least as tarnish-resistant as pure silver.

The internal oxidation may be furthered by heating the alloy composition to a temperature of between about 800° F. and 1300° F. in an oxygen-containing atmosphere. The oxygen-containing atmosphere may contain at least 20 percent oxygen.

The non-oxidizing atmosphere may be about 75 weight percent hydrogen and about 25 weight percent nitrogen. The non-oxidizing atmosphere may also be a reducing atmosphere. The reducing atmosphere may be a product of a carbon cover and/or a reducing flame.

The alloy composition may be formed with silver which is substantially oxygen-free. The oxygen may be removed from the silver by melting the silver in a reducing atmosphere. In this form, the reducing atmosphere may be a product of a carbon cover, the insertion of at least one carbon rod into the silver, and the heating of the silver to a temperature of at least about 2,200° F. for at least about 45 minutes.

The present invention also provides a process of making fine silver alloy compositions comprising the steps of combining silver having a purity of at least about 99.90 weight percent and being substantially oxygen-free, with at least one alloy element, or an oxide of the element, in a substantially non-oxidizing atmosphere, annealing the alloy composition in a substantially non-oxidizing atmosphere, and hardening the alloy composition by internal oxidation.

Accordingly, the general object of this invention is to provide various types of improved hardenable fine silver alloys.

Another object is to provide improved silver alloy compositions having at least 99.5 weight percent silver with the balance containing a number of selected elements or oxides of those elements, with the resulting composition being capable of being age-hardened to at least 136 percent of its annealed hardness. In this form, the increase in hardness of the resulting alloy composition may be irreversible.

Another object is to provide an improved fine silver alloy composition having at least 99.5 weight percent silver, with the balance being a number of selected elements or oxides of elements, such that the aged hardness of the alloy thus formed is at least about 48 VHN.

Another object is to provide various silver alloy compositions that exhibit a tarnish-resistance on the order of that for pure silver, and that are substantially more tarnish-resistant than sterling silver.

These and other objects and advantages will become apparent from the foregoing and ongoing written specification, the drawings, and the appended claims.

DESCRIPTION OF THE PREFERRED EMBODIMENT(S)

Figure 1:
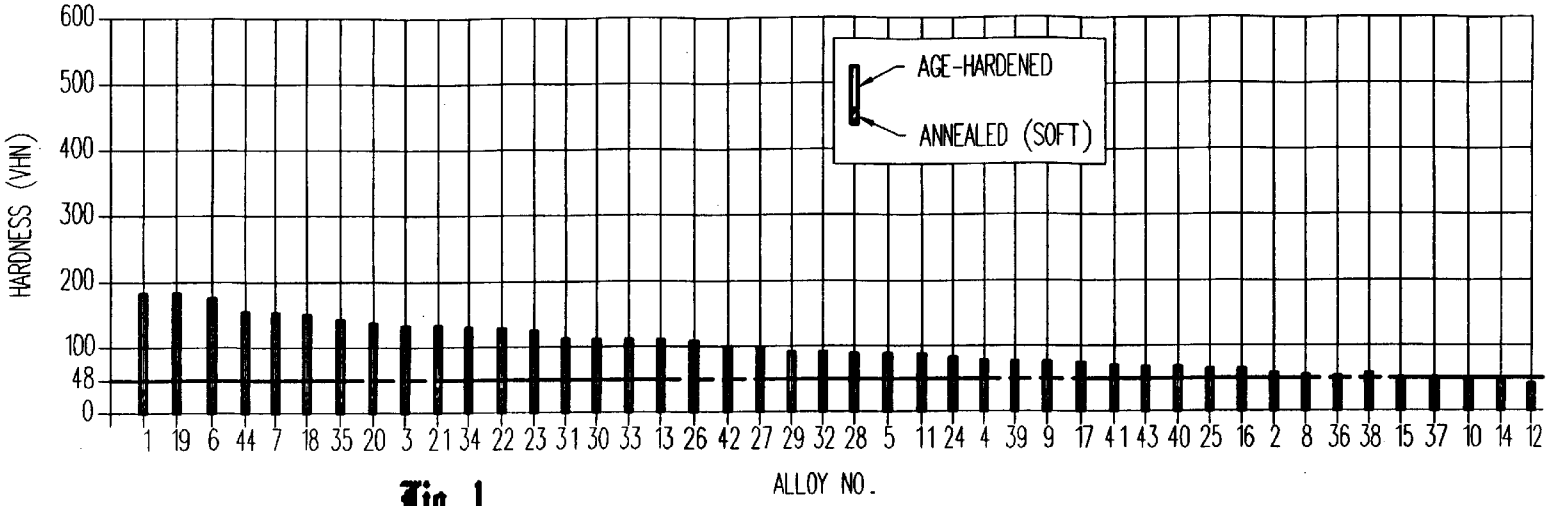
FIG. 1 is a bar graph showing the annealed and aged hardnesses of a number of specific alloys, this graph showing the various alloys as being arrayed in decreasing order of aged hardness.

At the outset, it should be clearly understood that like reference numerals are intended to identify the same structural elements, portions, or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up", and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis or elongation, or axis of rotation, as appropriate.

Applicants have discovered the composition of and process of forming a number of fine silver alloys that have the capability of substantially increased hardness when transitioning from an annealed condition to an aged condition. This increase in hardness is a function of the composition of the alloy and the process by which the alloy is formed, annealed, and hardened.

Composition

As used herein, the expression "fine silver" refers to a silver alloy composition having at least 99.5 weight percent silver. The balance of these alloy compositions may be an element, or an oxide of an element, selected from the group consisting of: aluminum, antimony, cadmium, gallium, germanium, indium, lithium, manganese, magnesium, silicon, tin, titanium and zinc. The alloys of the improved composition are capable of being age-hardened to at least 136 percent of their annealed hardness, and this hardening process may be irreversible.

Applicants' hardenability data as to a number of tested alloys are set forth in Table 1 herein. In this table, the alloys are simply identified by alloy numbers. The composition of the alloy is then specified in terms of its weight percentage of silver and weight percentage of other alloying elements. The annealed (i.e. soft) hardness, rolled hardness and aged hardness are then set forth thereafter. The next column is then an expression as to the percentage change in hardness (i.e., aged/soft×100%). The rightwardmost column expresses the increase in hardness between the annealed and aged values (i.e., (aged-soft)/soft×100%).

TABLE 1

Hardenability Data

| | Composition | | Hardness (VHN) | | | | % Inc in |
|---|---|---|---|---|---|---|---|
| Alloy No. | % Ag | % Element | Soft | As Rolled | Aged | % Chng | Hardness |
| 1 | 99.570% | 0.430% Al | 34 | 114 | 183 | 538% | 438% |
| 2 | 99.650% | 0.350% Cd | 32 | 106 | 57 | 178% | 78% |
| 3 | 99.530% | 0.470% Ga | 30.5 | 105 | 132 | 432% | 333% |
| 4 | 99.570% | 0.430% In | 27 | 100 | 78 | 289% | 189% |
| 5 | 99.560% | 0.440% Li | 32 | 106 | 88 | 275% | 175% |
| 6 | 99.720% | 0.280% Mg | 34 | 112 | 175 | 515% | 415% |
| 7 | 99.540% | 0.460% Mn | 29 | 114 | 153 | 527% | 428% |
| 8 | 99.500% | 0.500% Sb | 30 | 114 | 55 | 183% | 83% |
| 9 | 99.500% | 0.500% Sn | 30.5 | 107 | 75 | 245% | 146% |
| 10 | 99.996% | 0.004% Ti | 33 | 99 | 48 | 145% | 45% |
| 11 | 99.550% | 0.450% Zn | 30 | 107 | 87 | 290% | 190% |
| 12 | 99.980% | 0.020% (Total of all impurities) | 35 | 97 | 33 | 94% | −6% |
| 13 | 92.500% | 7.500% Cu | 80 | 140 | 110 | 138% | 38% |
| 14 | 99.993% | 0.007% Li | 31 | 107 | 44.5 | 144% | 44% |
| 15 | 99.991% | 0.009% Li | 32 | 106 | 51 | 159% | 59% |
| 16 | 99.970% | 0.030% Li | 33.5 | 111 | 64 | 191% | 91% |

TABLE 1-continued

Hardenability Data

| | Composition | | Hardness (VHN) | | | | % Inc in |
|---|---|---|---|---|---|---|---|
| Alloy No. | % Ag | % Element | Soft | As Rolled | Aged | % Chng | Hardness |
| 17 | 99.964% | 0.036% Li | 29.5 | 108 | 74 | 251% | 151% |
| 18 | 99.703% | 0.279% Al 0.018% Mn | 30 | 125 | 150 | 500% | 400% |
| 19 | 99.649% | 0.295% Al 0.056% Mn | 33 | 120 | 182.5 | 553% | 453% |
| 20 | 99.671% | 0.294% Al 0.035% Li | 35.5 | 121 | 136.5 | 385% | 285% |
| 21 | 99.748% | 0.209% Al 0.043% Li | 36.5 | 122 | 132 | 362% | 262% |
| 22 | 99.778% | 0.035% Li 0.187% Mn | 33.5 | 112.5 | 128.5 | 384% | 284% |
| 23 | 99.770% | 0.024% Li 0.206% Mn | 29 | 113 | 123.5 | 426% | 326% |
| 24 | 99.839% | 0.161% Ga | 23.5 | 118 | 82 | 349% | 249% |
| 25 | 99.922% | 0.078% Ga | 32.5 | 108 | 64.5 | 198% | 98% |
| 26 | 99.779% | 0.221% Ga | 29 | 106.5 | 108 | 372% | 272% |
| 27 | 99.815% | 0.185% Ga | 24 | 121 | 98 | 408% | 308% |
| 28 | 99.799% | 0.201% Zn | 24.5 | 117 | 88.5 | 361% | 261% |
| 29 | 99.773% | 0.227% Zn | 25 | 116.5 | 91 | 364% | 264% |
| 30 | 99.618% | 0.382% Zn | 30 | 117 | 111.5 | 371% | 272% |
| 31 | 99.601% | 0.399% Zn | 24.5 | 120 | 112 | 457% | 357% |
| 32 | 99.904% | 0.096% Al | 26.5 | 123 | 91 | 343% | 243% |
| 33 | 99.851% | 0.149% Al | 29 | 120.5 | 111 | 383% | 283% |
| 34 | 99.796% | 0.204% Al | 29.5 | 124 | 130 | 441% | 341% |
| 35 | 99.774% | 0.226% Al | 31 | 129 | 141.5 | 456% | 356% |
| 36 | 99.585% | 0.415% Ge | 32 | 135 | 53 | 166% | 65% |
| 37 | 99.807% | 0.193% Ge | 35.5 | 107 | 51 | 144% | 44% |
| 38 | 99.851% | 0.149% Si | 57 | 136 | 53 | 93% | −7% |
| 39 | 99.809% | 0.191% Si | 56 | 151 | 76 | 136% | 36% |
| 40 | 99.828% | 0.172% In | 32 | 106 | 68 | 213% | 113% |
| 41 | 99.796% | 0.204% In | 31 | 110 | 69 | 223% | 123% |
| 42 | 99.809% | 0.191% Li | 41 | 123 | 99 | 241% | 141% |
| 43 | 99.978% | 0.022% Li | 35 | 114 | 68 | 194% | 94% |
| 44 | 99.688% | 0.073% Mg 0.239% Mn | 41.5 | 109 | 155 | 373% | 273% |

Table 2 contains the same hardenability data as set forth in claim 1, although the data set forth in Table 2 is arranged in ascending order of aged hardness. This data is plotted in FIG. 1. This figure depicts a series of bar graphs in which the hardness is plotted as a function of the particular alloy number. The bar for each alloy is shown as having two portions, the annealed hardness and the aged hardness. In this regard, the horizontal line at an indicated hardness of about 48 VHN indicates the cut-off point of alloys falling within the scope of certain of the appended claims.

TABLE 2

Hardenability Data

| | Composition | | Hardness (VHN) | | | | % Inc in |
|---|---|---|---|---|---|---|---|
| Alloy No. | % Ag | % Element | Soft | As Rolled | Aged | % Chng | Hardness |
| 12 | 99.980% | 0.020% (total of all impurities) | 36 | 97 | 33 | 94% | −6% |
| 14 | 99.993% | 0.007% Li | 31 | 107 | 44.5 | 144% | 44% |
| 10 | 99.996% | 0.004% Ti | 33 | 99 | 48 | 145% | 45% |
| 37 | 99.807% | 0.193% Ge | 35.5 | 107 | 51 | 144% | 44% |
| 15 | 99.991% | 0.009% Li | 32 | 106 | 51 | 159% | 59% |
| 38 | 99.851% | 0.149% Si | 57 | 136 | 53 | 93% | −7% |
| 36 | 99.585% | 0.415% Ge | 32 | 135 | 53 | 166% | 65% |
| 8 | 99.500% | 0.500% Sb | 30 | 114 | 55 | 183% | 83% |

TABLE 2-continued

Hardenability Data

| Alloy No. | Composition % Ag | Composition % Element | Hardness (VHN) Soft | Hardness (VHN) As Rolled | Hardness (VHN) Aged | % Chng | % Inc in Hardness |
|---|---|---|---|---|---|---|---|
| 2 | 99.650% | 0.350% Cd | 32 | 106 | 57 | 178% | 78% |
| 16 | 99.970% | 0.030% Li | 33.5 | 111 | 64 | 191% | 91% |
| 25 | 99.922% | 0.078% Ga | 32.5 | 108 | 64.5 | 198% | 98% |
| 40 | 99.828% | 0.172% In | 32 | 106 | 68 | 213% | 113% |
| 43 | 99.978% | 0.022% Li | 35 | 114 | 68 | 194% | 94% |
| 41 | 99.796% | 0.204% In | 31 | 110 | 69 | 223% | 123% |
| 17 | 99.964% | 0.036% Li | 29.5 | 108 | 74 | 251% | 151% |
| 9 | 99.500% | 0.500% Sn | 30.5 | 107 | 75 | 245% | 146% |
| 39 | 99.809% | 0.191% Si | 56 | 151 | 76 | 136% | 36% |
| 4 | 99.570% | 0.430% In | 27 | 100 | 78 | 289% | 189% |
| 24 | 99.839% | 0.161% Ga | 23.5 | 118 | 82 | 349% | 249% |
| 11 | 99.550% | 0.450% Zn | 30 | 107 | 87 | 290% | 190% |
| 5 | 99.560% | 0.440% Li | 32 | 106 | 88 | 275% | 175% |
| 28 | 99.799% | 0.201% Zn | 24.5 | 117 | 88.5 | 361% | 261% |
| 32 | 99.904% | 0.096% Al | 26.5 | 123 | 91 | 343% | 243% |
| 29 | 99.773% | 0.227% Zn | 25 | 116.5 | 91 | 364% | 264% |
| 27 | 99.815% | 0.185% Ga | 24 | 121 | 98 | 408% | 308% |
| 42 | 99.809% | 0.191% Li | 41 | 123 | 99 | 241% | 141% |
| 26 | 99.779% | 0.221% Ga | 29 | 106.5 | 108 | 372% | 272% |
| 13 | 92.500% | 7.500% Cu | 80 | 140 | 110 | 138% | 38% |
| 33 | 99.851% | 0.149% Al | 29 | 120.5 | 111 | 383% | 283% |
| 30 | 99.618% | 0.382% Zn | 30 | 117 | 111.5 | 371% | 272% |
| 31 | 99.601% | 0.399% Zn | 24.5 | 120 | 112 | 457% | 357% |
| 23 | 99.770% | 0.024% Li<br>0.206% Mn | 29 | 113 | 123.5 | 426% | 326% |
| 22 | 99.778% | 0.035% Li<br>0.187% Mn | 33.5 | 112.5 | 128.5 | 384% | 284% |
| 34 | 99.796% | 0.204% Al | 29.5 | 124 | 130 | 441% | 341% |
| 21 | 99.748% | 0.209% Al<br>0.043% Li | 36.5 | 122 | 132 | 362% | 262% |
| 3 | 99.530% | 0.470% Ga | 30.5 | 105 | 132 | 432% | 333% |
| 20 | 99.671% | 0.294% Al<br>0.035% Li | 35.5 | 121 | 136.5 | 385% | 285% |
| 35 | 99.774% | 0.226% Al | 31 | 129 | 141.5 | 456% | 356% |
| 18 | 99.703% | 0.279% Al<br>0.018% Mn | 30 | 125 | 150 | 500% | 400% |
| 7 | 99.540% | 0.460% Mn | 29 | 114 | 153 | 527% | 428% |
| 44 | 99.688% | 0.073% Mg<br>0.239% Mn | 41.5 | 109 | 155 | 373% | 273% |
| 6 | 99.720% | 0.280% Mg | 34 | 112 | 175 | 515% | 415% |
| 19 | 99.649% | 0.295% Al<br>0.056% Mn | 33 | 120 | 182.5 | 553% | 453% |
| 1 | 99.570% | 0.430% Al | 34 | 114 | 183 | 538% | 438% |

Figure 2:
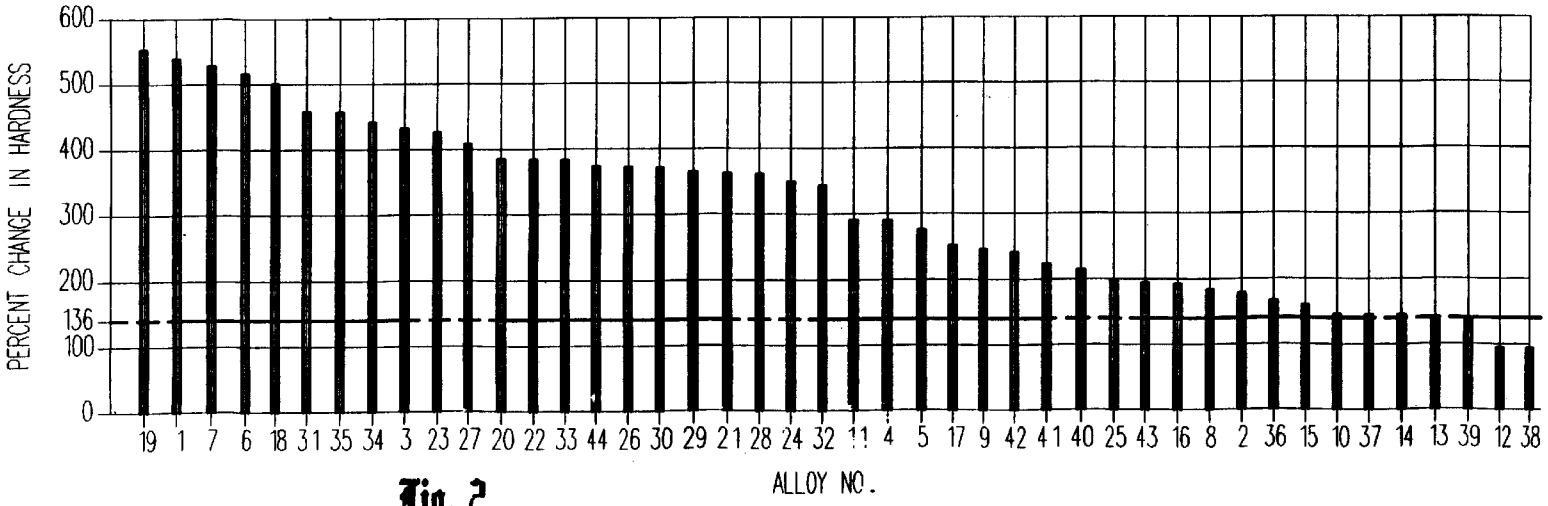
FIG. 2 is a bar graph showing the percentage of increase in hardness for the various alloys shown in FIG. 1, this view showing the alloys as being arranged in decreasing order of percentage hardness increase.
Figure 3:
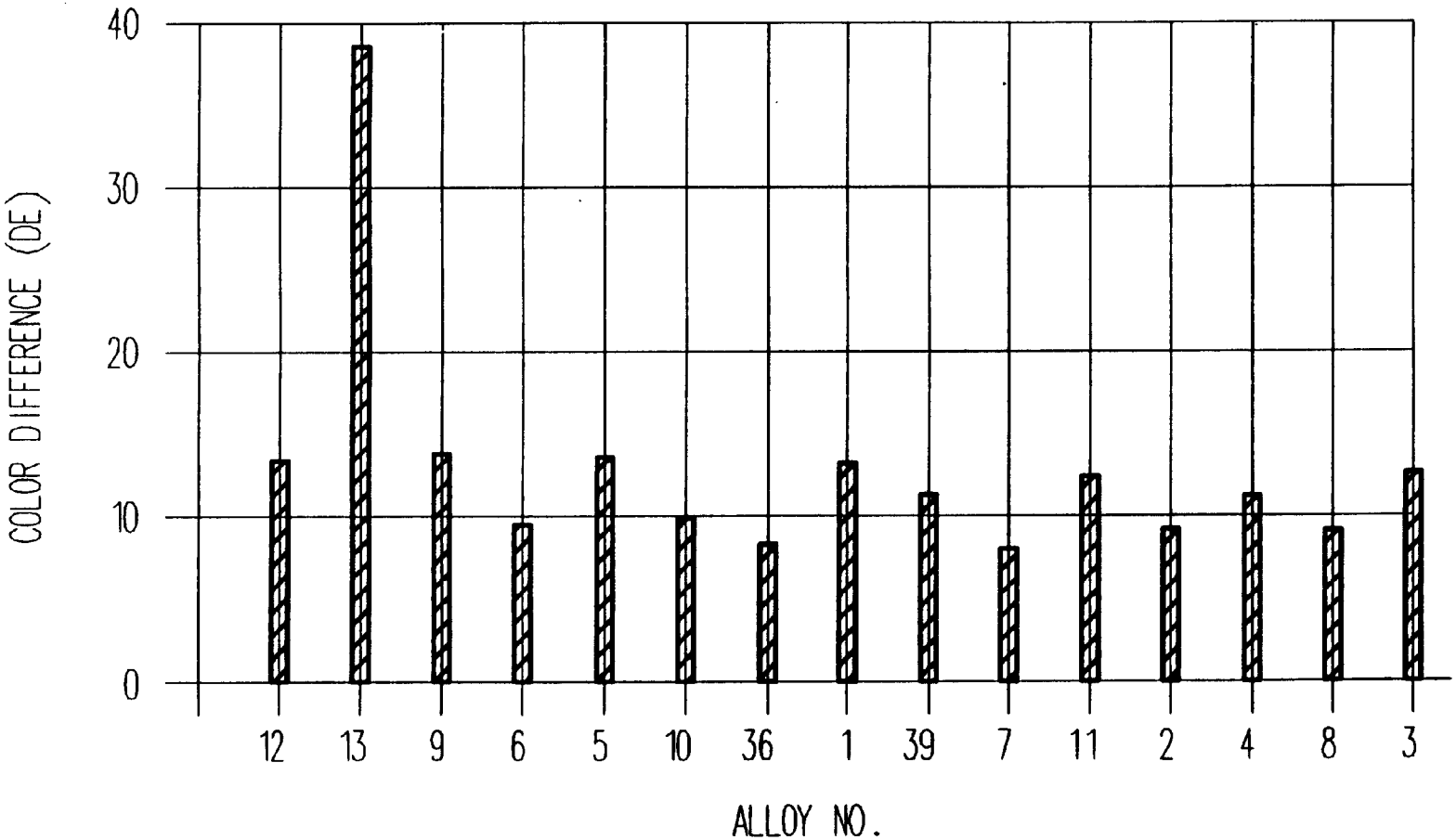
FIG. 3 is a bar graph showing the change in color of various alloys after exposure to a tarnishing vapor.

Table 3 contains the same data as depicted in Tables 1 and 2, albeit sorted in ascending order of percent change in hardness. This data is plotted in FIG. 2, in which the percent change in hardness increase is plotted as a function of the alloy number. In this view, the minimum increase for inclusion within the claimed alloy is whether the percent change in hardness is greater than about 136 percent. Those tested alloys having a percent change in hardness greater than 136 percent fall within the scope of certain of the appended claims.

TABLE 3

Hardenability Data

| Alloy No. | Composition % Ag | Composition % Element | Hardness (VHN) Soft | Hardness (VHN) As Rolled | Hardness (VHN) Aged | % Chng | % Inc in Hardness |
|---|---|---|---|---|---|---|---|
| 38 | 99.851% | 0.149% Si | 57 | 136 | 53 | 93% | −7% |
| 12 | 99.980% | 0.020% (total of all impurities) | 36 | 97 | 41 | 114% | 14% |

TABLE 3-continued

Hardenability Data

| Alloy No. | Composition % Ag | Composition % Element | Hardness (VHN) Soft | Hardness (VHN) As Rolled | Hardness (VHN) Aged | % Chng | % Inc in Hardness |
|---|---|---|---|---|---|---|---|
| 39 | 99.809% | 0.191% Si | 56 | 151 | 76 | 136% | 36% |
| 13 | 92.500% | 7.500% Cu | 80 | 140 | 110 | 138% | 38% |
| 14 | 99.993% | 0.007% Li | 31 | 107 | 44.5 | 144% | 44% |
| 37 | 99.807% | 0.193% Ge | 35.5 | 107 | 51 | 144% | 44% |
| 10 | 99.996% | 0.004% Ti | 33 | 99 | 48 | 145% | 45% |
| 15 | 99.991% | 0.009% Li | 32 | 106 | 51 | 159% | 59% |
| 36 | 99.585% | 0.415% Ge | 32 | 135 | 53 | 166% | 65% |
| 2 | 99.650% | 0.350% Cd | 32 | 106 | 57 | 178% | 78% |
| 8 | 99.500% | 0.500% Sb | 30 | 114 | 55 | 183% | 83% |
| 16 | 99.970% | 0.030% Li | 33.5 | 111 | 64 | 191% | 91% |
| 43 | 99.978% | 0.022% Li | 35 | 114 | 68 | 194% | 94% |
| 25 | 99.922% | 0.078% Ga | 32.5 | 108 | 64.5 | 198% | 98% |
| 40 | 99.828% | 0.172% In | 32 | 106 | 68 | 213% | 113% |
| 41 | 99.796% | 0.204% In | 31 | 110 | 69 | 223% | 123% |
| 42 | 99.809% | 0.191% Li | 41 | 123 | 99 | 241% | 141% |
| 9 | 99.500% | 0.500% Sn | 30.5 | 107 | 75 | 245% | 146% |
| 17 | 99.964% | 0.036% Li | 29.5 | 108 | 74 | 251% | 151% |
| 5 | 99.560% | 0.440% Li | 32 | 106 | 88 | 275% | 175% |
| 4 | 99.570% | 0.430% In | 27 | 100 | 78 | 289% | 189% |
| 11 | 99.550% | 0.450% Zn | 30 | 107 | 87 | 290% | 190% |
| 32 | 99.904% | 0.096% Al | 26.5 | 123 | 91 | 343% | 243% |
| 24 | 99.839% | 0.161% Ga | 23.5 | 118 | 82 | 349% | 249% |
| 28 | 99.799% | 0.201% Zn | 24.5 | 117 | 88.5 | 361% | 261% |
| 21 | 99.748% | 0.209% Al<br>0.043% Li | 36.5 | 122 | 132 | 362% | 262% |
| 29 | 99.773% | 0.227% Zn | 25 | 116.5 | 91 | 364% | 264% |
| 30 | 99.618% | 0.382% Zn | 30 | 117 | 111.5 | 371% | 272% |
| 26 | 99.779% | 0.221% Ga | 29 | 106.5 | 108 | 372% | 272% |
| 44 | 99.688% | 0.073% Mg<br>0.239% Mn | 41.5 | 109 | 155 | 373% | 273% |
| 33 | 99.851% | 0.149% Al | 29 | 120.5 | 111 | 383% | 283% |
| 22 | 99.778% | 0.035% Li<br>0.187% Mn | 33.5 | 112.5 | 128.5 | 384% | 284% |
| 20 | 99.671% | 0.294% Al<br>0.035% Li | 35.5 | 121 | 136.5 | 385% | 285% |
| 27 | 99.815% | 0.185% Ga | 24 | 121 | 98 | 408% | 308% |
| 23 | 99.770% | 0.024% Li<br>0.206% Mn | 29 | 113 | 123.5 | 426% | 326% |
| 3 | 99.530% | 0.470% Ga | 30.5 | 105 | 132 | 432% | 333% |
| 34 | 99.796% | 0.204% Al | 29.5 | 124 | 130 | 441% | 341% |
| 35 | 99.774% | 0.226% Al | 31 | 129 | 141.5 | 456% | 356% |
| 31 | 99.601% | 0.399% Zn | 24.5 | 120 | 112 | 457% | 357% |
| 18 | 99.703% | 0.279% Al<br>0.018% Mn | 30 | 125 | 150 | 500% | 400% |
| 6 | 99.720% | 0.280% Mg | 34 | 112 | 175 | 515% | 415% |
| 7 | 99.540% | 0.460% Mn | 29 | 114 | 153 | 527% | 428% |
| 1 | 99.570% | 0.430% Al | 34 | 114 | 183 | 538% | 438% |
| 19 | 99.649% | 0.295% Al<br>0.056% Mn | 33 | 120 | 182.5 | 553% | 453% |

Applicants have also discovered that the improved alloys exhibit a resistance to tarnishing that is on the order of, or greater than, that of pure silver, and substantially better than the tarnish resistance of sterling silver. Resistance to tarnishing can be quantitively measured by a change in color following exposure to a tarnishing vapor (e.g., including chlorides, sulfides and acetic acid) for about one-half hour. Strength of the tarnishing vapor and time of the exposure are believed to be interrelated quantities, and can be varied as desired. Color is measured in terms of CIE units on three mutually-perpendicular axes, with L* representing a color's brightness on a white-black axis (i.e., L*0 representing black and L*100 representing white, a* representing a color variable on a red-green axis (i.e., a*100 being red and a*−100 being green), and b* representing another color variable on a yellow-blue axis (i.e., b*100 being yellow and b*−100 being blue. The difference (DE) between two colors $(L^*_1, a^*_1, b^*_1)$ and $(L^*_2, a^*_2, b^*_2)$ can then be calculated as a distance between two corresponding points according to the equation:

$$DE=[(L^*_2-L^*_1)^2+(a^*_2-a^*_1)^2+(b^*_2-b^*_1)^2]^{1/2}$$

In order to obtain a uniform surface condition, all samples were tumbled in abrasive media and then in steel shot. The samples were then cleaned ultrasonically in a soap solution and rinsed. The color of the samples was measured before and after exposure to a tarnishing vapor for about one-half hour. Color was measured by the CIELAB mathematical color measuring system, using a "C" light source, including the specula and ultraviolet components, and with the observer positioned at an angle of 2 degrees. Applicant's tarnish-resistance data is shown in FIG. 4:

TABLE 4

Tarnish Resistance Data

| Alloy No. | Composition % Ag | Composition % Element | Before Exposure $L^*_1$ | Before Exposure $a^*_1$ | Before Exposure $b^*_1$ | After Exposure $L^*_2$ | After Exposure $a^*_2$ | After Exposure $b^*_2$ | DE |
|---|---|---|---|---|---|---|---|---|---|
| 12 | 99.980% | 0.020% (Total of all impurities) | 94 | −0.4 | 5.6 | 83.1 | 0.4 | 13.3 | 13.4 |
| 13 | 92.500% | 7.500% Cu | 93.3 | −0.7 | 5.5 | 64.7 | 10.1 | 29.0 | 38.6 |
| 9 | 99.500% | 0.500% Sn | 94.1 | −0.3 | 4.2 | 83.6 | 0.4 | 13.1 | 13.8 |
| 6 | 99.720% | 0.280% Mg | 93.2 | 0 | 4.5 | 86.9 | 0.1 | 11.6 | 9.5 |
| 5 | 99.560% | 0.440% Li | 94.1 | −0.2 | 4.2 | 83.8 | 0.7 | 13.1 | 13.6 |
| 10 | 99.996% | 0.004% Ti | 93.5 | −0.2 | 5.1 | 85.6 | 0.3 | 11.0 | 9.9 |
| 36 | 99.585% | 0.415% Ge | 93.4 | −0.4 | 5.2 | 87.1 | −0.5 | 10.6 | 8.3 |
| 1 | 99.570% | 0.430% Al | 93.4 | −0.5 | 5.5 | 82.4 | 0.2 | 12.7 | 13.2 |
| 39 | 99.809% | 0.191% Si | 93.5 | −0.4 | 4.2 | 85.1 | −0.2 | 11.8 | 11.3 |
| 7 | 99.540% | 0.460% Mn | 92.6 | 0.2 | 5.7 | 86.4 | 0 | 10.6 | 8.0 |
| 11 | 99.550% | 0.450% Zn | 94.1 | 0 | 3.4 | 84.9 | 0.2 | 11.9 | 12.4 |
| 2 | 99.650% | 0.350% Cd | 92.8 | 0.6 | 3.9 | 86.9 | 0 | 11.0 | 9.2 |
| 4 | 99.570% | 0.430% In | 94.4 | −0.3 | 4.2 | 85.7 | 0.3 | 11.3 | 11.2 |
| 8 | 99.500% | 0.500% Sb | 93.4 | −0.3 | 5.0 | 86.8 | 0 | 11.3 | 9.1 |
| 3 | 99.530% | 0.470% Ga | 94.3 | 0 | 3.7 | 85.3 | 0.3 | 12.6 | 12.6 |

The color of applicants' improved alloys before exposure is substantially the same as pure silver, and not substantially different from the color of sterling silver. Any color differences between the improved alloys and sterling silver were so slight as to be virtually indistinguishable to the human eye.

Therefore, the present invention provides an improved fine silver alloy composition that contains at least about 99.5 weight percent silver. The composition is capable of being aged-hardened to at least 136 percent of its annealed hardness, and this hardening may be irreversible. The aged hardness is at least 48 VHN. The alloy includes at least 99.5 weight percent silver, with the balance including an element, or an oxide of an element (or both) selected from the group consisting of aluminum, antimony, cadmium, gallium, germanium, indium, lithium, manganese, magnesium, silicon, tin, titanium and zinc.

Process

The hardnesses set forth in Tables 1–3 and the tarnish-resistance reflected in Table 4 are not only a function of the specific elements used to form the alloy, but also the process by which the alloy is formed.

Of course, the primary element of the claimed alloy is silver. To assure that the alloy contains at least about 99.5 weight percent silver and meets the purity standards set forth by National Gold and Silver Stamping Act, the ingredients used to form the alloy should be of especially high purity. In particular, the silver into which the alloy elements are melted should have a minimum purity of at least about 99.90 weight percent. In addition, in the preferred embodiment, the special alloy ingredients also have a minimum purity of 99.90 percent. For best results, the silver should be especially devoid of copper, zinc, gold, nickel, iron or platinum group metals (e.g., less than 25 parts per million).

Not only should the silver used to form the alloy have a minimum purity of about 99.90 weight percent, it should also have a low oxygen content. Nearly all commercially-available silver has a high oxygen content, which makes it brittle and prone to blistering, cracking, and other defects. In addition, the exact composition of applicants silver alloy is difficult to control without first removing the oxygen from the silver. Consequently, the oxygen content of the silver is lowered prior to the addition of the other alloy ingredients. Oxygen is removed from the silver by pre-melting the silver in a reducing atmosphere. The preferred reducing atmosphere is a carbon cover and a reducing flame. The preferred carbon cover is charcoal. The silver is placed in a crucible and covered with the charcoal. The crucible is heated and the charcoal extracts the oxygen from the silver, while also acting as a barrier to the oxygen in the surrounding air. The preferred reducing flame is carbon monoxide, which reacts with oxygen and removes it. Carbon rods are then inserted into the molten silver while it is held at a temperature of at least 2,200° F. for at least 45 minutes. The silver is then poured into castings. The preferred form of the casting is grain. Pouring is performed under a non-oxidizing atmosphere in order to keep oxygen pick-up at a minimum. As used herein, a non-oxidizing atmosphere means and includes a neutral/displacing atmosphere (one containing little or no oxygen) and/or a reducing atmosphere (an atmosphere in which oxygen is actively removed).

Once the silver is in grain form and substantially oxygen free, it can be combined with the special alloy ingredients to form the claimed silver alloy. Because the special alloy ingredients oxidize readily, the preferred method of mixing the ingredients is to first place half of the pure silver in the crucible, to then place the special alloy ingredients on top of the silver, and to then cover the alloy ingredients with the remaining half of the silver. Again, it is important that the melting of the special alloy ingredients and the silver occur in a non-oxidizing atmosphere. To achieve this, a carbon cover and a reducing flame should cover the mix during the melting process. The carbon should be the fourth layer in the crucible, covering the second half of the silver. This carbon cover acts as a barrier to oxygen, as well as a reducing agent. Because of the order in which the silver and special alloy ingredients are mixed, the silver on the bottom of the crucible will melt first, allowing the special alloy ingredients to then fall into the molten silver. This aids in mixing the alloy and preventing oxidation of the special alloy ingredients. When the mixture is completely molten, carbon rods are inserted to further prevent oxidation and aid in reducing the nix.

Once the appropriate temperatures are reached, the mixture may be poured. Again, oxidation is kept to a minimum and the molten alloy is protected from oxygen pickup by using a reducing flame in the mold and on the pour stream.

In order to maintain the ductility of the alloy when processing the alloy into a finished product, it is sometimes necessary to periodically soften it by reheating. This annealing process is also performed in a non-oxidizing atmosphere. In the preferred process, a 75 percent hydrogen ($H_2$) and a 25 percent nitrogen ($N_2$) atmosphere is used. Annealing temperatures are maintained at 600–800° F., depending on the thickness of the raw product and the amount of product in the furnace. Temperatures and annealing time should be kept as low as possible to prevent grain growth.

The alloy is hardened after fabrication to greatly improve its strength. Where previous stages are performed in a non-oxidizing atmosphere, this final stage is conducted in an oxidizing environment. The hardening is performed in an oxygen-containing atmosphere, such as air (which contains about 20 percent oxygen). During this stage, oxygen is diffused into the alloy composition to further internal oxidation. The rate at which the alloy is hardened depends on the temperature used and the amount of available oxygen. In the preferred process, the temperature is maintained at between 800–1300° F. The hardening time varies as the square of the thickness of the alloy. Where "t" is the thickness, "T" the time, and "K" a diffusion constant (which is a function of available oxygen, temperature, and alloy elements), the hardening time $T=K\ t^2$.

As a result of using the aforementioned process in combination with the alloy compositions described above, a finished silver alloy is formed which has a high silver purity and a hardness that, until now, has not been able to be achieved. Not only does the alloy have a high silver content and a high hardness, but the hardening is irreversible. The benefit of irreversibility is that reheating the alloy (e.g. torch soldering) can be performed without losing hardness. This provides wonderful advantages for craftsman, jewelers, and other artisans. In addition, such reheating does not result in the discoloration or tarnishing found with other alloys. With the improved alloy, reheating does not result in "firescale".

Therefore, the present invention provides an improved fine silver alloy composition that contains at least about 99.5 weight percent silver. The composition is capable of being aged-hardened to at least 136 percent of its annealed hardness, and this hardening may be irreversible. This hardening is performed through a process in which very pure silver is mixed with a select combination of alloy ingredients in a non-oxidizing atmosphere. Annealing of the alloy is also conducted in a non-oxidizing atmosphere. The alloy is then hardened in an oxygen-containing atmosphere which promotes internal oxidation. The result is a irreversibly-hardened and tarnish-resistant fine silver alloy.

Accordingly, while several preferred forms of the improved silver alloy compositions and process have been shown and described, and various modification thereof discussed, persons skilled in this art will readily appreciate that various additional changes and modifications may be made without departing from the spirit of the invention, as defined and differentiated in the following claims.

What is claimed is:

1. A silver alloy composition having at least 99.54 weight percent silver, with the balance consisting essentially of an oxide of an element selected from the group consisting of aluminum, antimony, cadmium, gallium, germanium, indium, manganese, magnesium, silicon, titanium and zinc, said oxide effective to cause said silver alloy to have a greater tarnish resistance than 99.98 weight percent silver when exposed to a tarnishing vapor including chlorides, sulfides and acetic acid.

2. The silver alloy of claim 1 having an aged hardness of at least 48 VHN.

3. The silver alloy of claim 2 wherein said age hardened hardness is at least 136% of an annealed hardness of said silver alloy.

4. The silver alloy of claim 3 formed into an ornamental object.

5. The silver alloy of claim 4 wherein a difference (DE) between a color of said silver alloy before exposure to a tarnishing vapor and subsequent to exposure to said tarnishing vapor is less than 11.

6. The silver alloy of claim 5 having about 0.280%, by weight, of magnesium.

7. The silver alloy of claim 5 having, by weight, about 0.004% of titanium.

8. The silver alloy of claim 5 having, by weight, about 0.415% of germanium.

9. The silver alloy of claim 5 wherein said oxide is manganese oxide.

10. The silver alloy of claim 9 having, by weight, about 0.460% of manganese.

11. The silver alloy of claim 5 having, by weight, about 0.350% of cadmium.

* * * * *